US007794279B1

(12) United States Patent
Ye et al.

(10) Patent No.: US 7,794,279 B1
(45) Date of Patent: Sep. 14, 2010

(54) PLUG CONNECTOR

(75) Inventors: Chao-Yong Ye, Tu-Cheng (TW); Kai-Hsiang Chang, Tu-Cheng (TW); Kuo-Chin Lin, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/461,939

(22) Filed: Aug. 28, 2009

(51) Int. Cl.
*H01R 9/03* (2006.01)

(52) U.S. Cl. ..... 439/607.54; 439/607.41

(58) Field of Classification Search ..... 439/607.41, 439/607.5, 607.54, 607.55
See application file for complete search history.

(56) References Cited

U.S. PATENT DOCUMENTS 5,733,146 A * 3/1998 Block ..... 439/607.54
6,595,801 B1 * 7/2003 Leonard et al. ..... 439/607.55
6,913,489 B2 * 7/2005 Chai et al. ..... 439/607.54
7,252,549 B2 * 8/2007 Nishio et al. ..... 439/607.55
7,648,396 B2 * 1/2010 Nickol et al. ..... 439/607.54

* cited by examiner

*Primary Examiner*—Khiem Nguyen
(74) *Attorney, Agent, or Firm*—Rosenberg, Klein & Lee

(57) ABSTRACT

A plug connector connected with a cable has a base and an insertion portion at a front of the base. A terminal is fixed to the base, having a soldering slice connecting with the cable. A first shell is coupled with the insertion portion. A second shell coupled with the base has a lip plate covering a top surface of the base. An edge of the lip plate is extended to form a lateral plate at a front thereof, attached to a side of the base, and a connecting arm at a rear thereof and extending apart from the lateral plate. An opposite edge of the lip plate is extended to form a parcel plate bent around the base to connect the lateral plate. The parcel plate has a support arm extending beneath the connecting arm to form a passageway for allowing the cable to pass therethrough.

20 Claims, 3 Drawing Sheets

PLUG CONNECTOR

BACKGROUND OF THE INVENTION

1. Field of the Invention

The present invention relates to a plug connector, and particularly to a plug connector having an excellent shielding effect.

2. The Related Art

Plug connectors are provided with shell for avoiding electromagnetic interference. The conventional plug connector has an insulating housing. The insulating housing has a rectangular base and an insertion portion protruded forwards from a front end of the base. A plurality of terminals is mounted into the insulating housing for electrically connecting with a mating socket connector. Generally speaking, the plug connector has a first shell coupled with the insertion portion, a second shell coupled with the base, and a clamping shell surrounding a cable connected with the terminals, for achieving the shielding of electromagnetic interference. However, it is time-consuming and complicated to manufacture and assemble such shielding structure which involves the first shell, the second shell, and the clamping shell.

SUMMARY OF THE INVENTION

Accordingly, an object of the present invention is to provide a plug connector connected with a cable. The plug connector has an insulating housing. The insulating housing has a base and an insertion portion extended forwards from a front surface of the base. An outer peripheral dimension of the insertion portion is smaller than that of the base. A plurality of terminals is mounted into the insulating housing. Each of the terminals has a soldering slice extending rearward of the base for connecting with the cable. A shell has a first shell coupled with the insertion portion and a second shell coupled with the base. The second shell has a lip plate covering a top surface of the base. An edge of the lip plate is extended downwards to form a lateral plate at a front thereof, attached to a side of the base, and a connecting arm at a rear thereof and extending apart from the lateral plate. An opposite edge of the lip plate is extended downwards to form a parcel plate bent around the base to connect with the lateral plate for enclosing the base. The parcel plate has a support arm extending beneath the connecting arm to form a passageway for allowing the cable to pass therethrough to connect with the soldering slices.

As described above, the first shell and the second shell are respectively coupled with the insertion portion and the base, which wraps the insulating housing to avoid electromagnetic interference. The second shell has the support arm and the connecting arm, which surround the cable connected with the terminals for avoiding electromagnetic interference. Such structure is excellent to shield the plug connector from electromagnetic interference, furthermore, it simplifies the process of manufacture and assembly.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
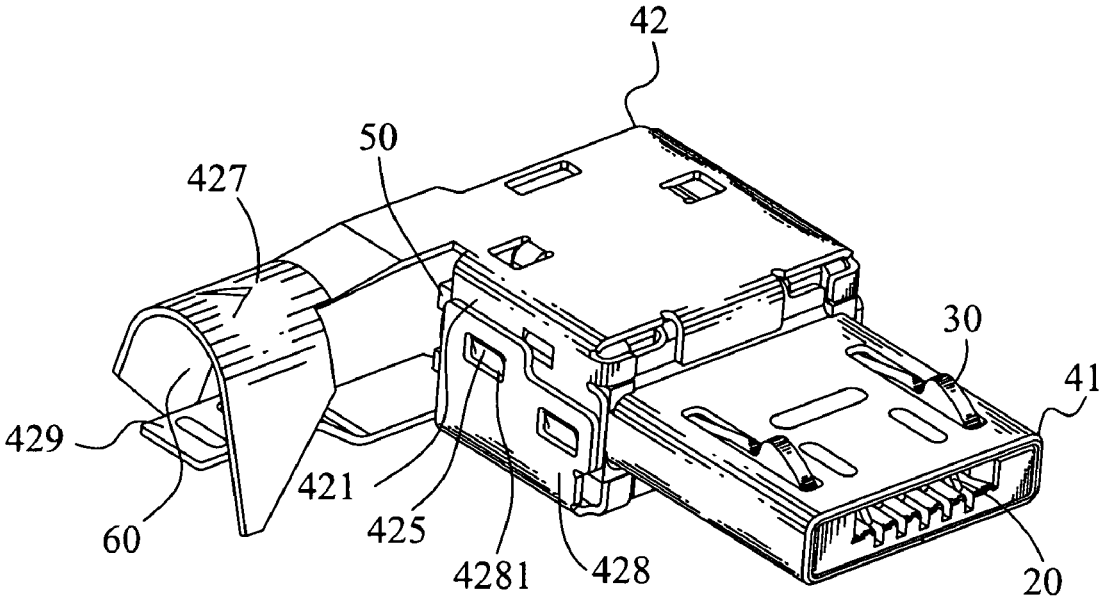
FIG. 1 is an assembled, perspective view of a plug connector of an embodiment in accordance with the present invention.
Figure 2:
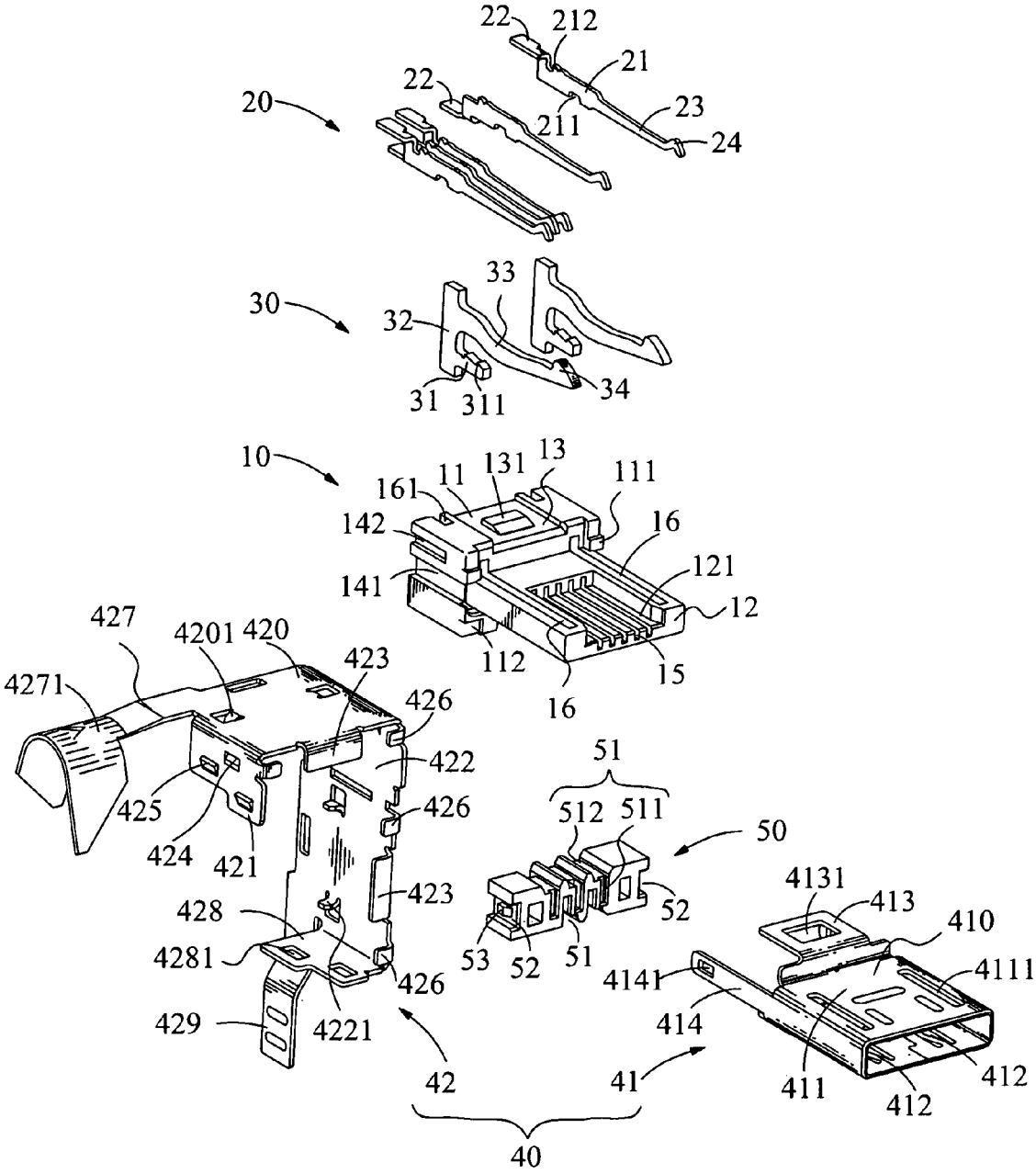
FIG. 2 is an exploded, perspective view of the plug connector shown in FIG. 1.

Referring to the drawings in greater detail, and first to FIGS. 1-2, the embodiment of the invention is embodied in a plug connector. The plug connector comprises an insulating housing 10, a plurality of terminals 20 mounted to the insulating housing 10, and a shell 40 coupled with the insulating housing 10.

Figure 3:
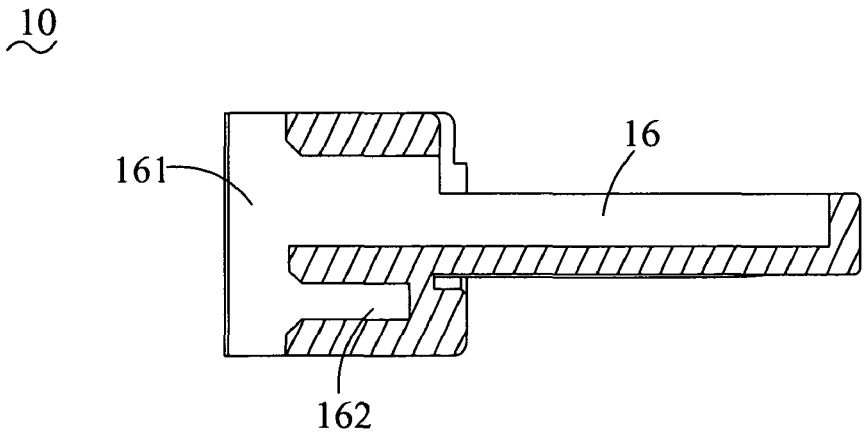
FIG. 3 is a cross-sectional view of an insulating housing of the plug connector shown in FIG. 2.

With reference to FIGS. 2-3, the insulating housing 10 has a rectangular base 11 and an insertion portion 12 protruded forwards from a front surface 111 of the base 11 and inserted into a mating socket connector (not shown) along a front-to-rear direction. The base 11 has an indentation area 13 at a middle of a top surface thereof. The indentation area 13 is enlarged to the front surface 111 and a rear surface of the base 11. A protrusion 131 is formed at a center of the indentation area 13, having an inclining surface facing forwards. Each of two opposite sides of the base 11 has a through recess 141 extending along a front and rear direction at a substantially middle portion thereof, and a buckling recess 142 above the through recess 141 and parallel to the through recess 141. The buckling recess 142 is spaced away from the through recess 141, with a closed end adjacent to the front surface 111. The front surface 111 has a notch 112 at each of corners thereof.

The insertion portion 12 has an outer peripheral dimension smaller than that of the base 11. A top of the insertion portion 12 is recessed to form a receiving recess 121, which extends to reach a front surface of the insertion portion 12, and a pair of fixing grooves 16 disposed at two sides of the receiving recess 121 symmetrically. A plurality of terminal grooves 15 is formed at a bottom of the receiving recess 121. The terminal grooves 15 extend frontward and rearwards, and pass through the whole insulating housing 10, for receiving the terminals 20. Each of the fixing grooves 16 extends in paralleled with the terminal grooves 15 and communicates with a slot 161 which is formed at a rear of the base 11 and extends upwards and downwards to reach the top surface and a bottom surface of the base 11. A bottom of the slot 161 penetrates forwards to form an auxiliary recess 162 spaced away from and under the fixing groove 16.

Referring to FIG. 2, the terminal 20 received in the terminal groove 15 comprises a fixing slice 21, a soldering slice 22 disposed at one end of the fixing slice 21, and a contact slice 23 disposed at the other end of the fixing slice 21. The fixing slice 21 is rectangular. A top side of the fixing slice 21 has barbs 212 adjacent to the soldering slice 22, interfering with an inner surface of terminal groove 15, and a bottom side of the fixing slice 21 has a gap 211 adjacent to the contact slice 23, engaging with a lump (not shown) formed at a bottom of the terminal groove 15, for fixing the terminal 20 in the terminal groove 15. The soldering slice 22 is extended perpendicularly from a rear of the top side or the bottom side of the fixing slice 21. In assembly, the two adjacent soldering slices 22 cooperatively form a substantially rectangular-cup shape. The contact slice 23 is extended forwards from a front end of the fixing slice 21 to show a strip shape. A free end of the contact slice 23 is bent upwards to form a contact end 24 of inverted-V shape, beyond a bottom of the receiving recess 121 for electrically connecting with contacts (not shown) of the mating socket connector.

In this embodiment, the plug connector is further provided with a positioning component 50. The positioning component 50 is a substantially rectangular block and has a plurality of positioning troughs 51, corresponding to the terminal grooves 15. Each of the positioning troughs 51 includes a vertical slot 511 formed at a front of the positioning component 50, and a flat recess 512 communicating with the vertical slot 511. The vertical slots 511 are arranged side by side. The flat recesses 512 are disposed at a top and a bottom of the positioning component 50 at intervals. A recess 52 cuts through a substantial middle of each of two opposite sides of the positioning component 50 along the front and rear direction. The recess 52 has a bottom protruded outwards to form a bump 53. In assembly, the positioning component 50 is located at the rear of the base 11, with the recess 52 being in alignment with the through recess 141. The rear ends of the fixing slices 21 are inserted into the vertical slots 511. The soldering slices 22, are received in the corresponding flat recesses 512 for being soldered with the cable (not shown). The positioning component 50 is capable of securing the terminals 20 with respect to the insulating housing 10 and spacing the soldering slices 22 from one another.

Please refer to FIGS. 2-3, a pair of locking elements 30 are mounted in the fixing grooves 16. The locking element 30 has a rectangular connecting piece 32 received in the slot 161, an auxiliary piece 31 extended perpendicularly from a lower portion of a long side of the connecting piece 32, and a locking arm 33 extended perpendicularly from an upper portion of the long side of the connecting piece 32. The auxiliary piece 31 is received in the auxiliary recess 162, with a top side thereof formed with barbs 311 for interfering with an inner surface of the auxiliary recess 162. The locking arm 33 is longer than the auxiliary piece 31. A free end of the locking arm 33 is protruded upwards to form locking end 34 in the form of lump, resiliently projecting beyond a top of the fixing groove 16 when the locking arm 33 is received in the fixing groove 16, for buckling with the mating socket connector steady.

Figure 4:
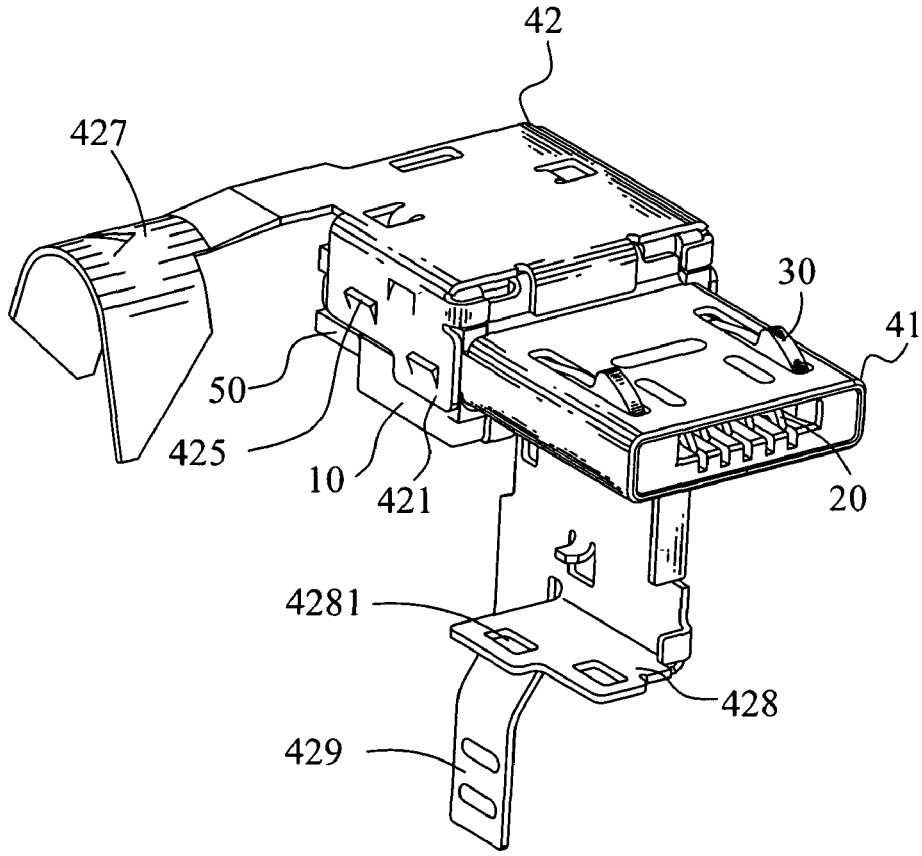
FIG. 4 is a perspective view showing a second shell of the plug connector assembled to the insulating housing incompletely.

With reference to the FIGS. 1-2 and FIG. 4, the shell 40 includes a first shell 41 coupled with the insertion portion 12, and a second shell 42 coupled with the base 11. The first shell 41 has a rectangular casing 410 enclosing an outer peripheral surface of the insertion portion 12. The casing 410 defines a top plate 411. The top plate 411 has two strip openings 4111, corresponding to the fixing grooves 16. The strip openings 4111 extend frontward and rearwards for allowing the locking end 34 to expose therethrough. A rear end of the top plate 411 is extended upwards and bent rearwards to form a buckling slice 413, received in the indentation area 13. The buckling slice 413 has a buckling opening 4131 at a center thereof and is coupled with the protrusion 131 for fixing the first shell 41 and the insulating housing 10 together. A plate of the casing 410 facing the top plate 411 is punched with a plurality of elastic pieces 412 for enhancing insertion and withdrawal force. Two lateral plates of the casing 410 are elongated rearwards to form clamping arms 414, with each rear end formed with an opening 4141. In assembly, each of the clamping arms 414 is accommodated in the corresponding through recess 141 and the recess 52 aligned with the through recess 141, and the opening 4141 is mated with the corresponding bump 53, for fixing the first shell 41 and the insulating housing 10 together.

The second shell 42 has a lip plate 420 covering the top surface of the base 11, a lateral plate 421 attached to one side of the base 11, and a parcel plate 422 bent to enclose the other side and the bottom of the base 11. The lip plate 420 is punched inwards to form two blocking pieces 4201, for being located rearward of the connecting pieces 32. A middle of a front side of the lip plate 420 is extended downwards to form a resting slice 423. The lateral plate 421 is extended downwards from a front portion of a lateral edge of the lip plate 420, and has a stab 424 slanting inwards for inserting into the buckling recess 142 of the insulating housing 10, and two connecting tabs 425 slanting outwards. In this embodiment, a bottom of the lateral plate has a front end lower than a rear end, correspondingly, the connecting tab forward of the other connecting tab is arranged lower than the other one. A front edge of the lateral plate 421 is extended inwards to form a clasping piece 426 hooking the notch 112 in assembly. A rear portion of the lateral edge of the lip plate 420 is extended levelly to form a connecting arm 427. The connecting arm 427 stretches beyond the lateral plate 421 with a predetermined distance and has a substantially inverted-U ferrule 4271 integrated a free end therewith.

The parcel plate 422 also has blocking pieces 4221 for being located rearward of the connecting pieces 32 , the clasping pieces 426 and the stab 423 extended inwards from a front edge thereof for clasping the front surface 111 of the base 11. A free end of the parcel plate 422 is bent inwards to form a connecting plate 428 at a front portion thereof, and a support arm 429 at a rear portion thereof. The connecting plate 428 has two mating openings 4281 corresponding to the connecting tabs 425. Herein, a bottom of the connecting plate has a rear end lower than a front end thereof, correspondingly, the connecting tab forward of the other connecting tab is arranged higher than the other one. The support arm 428 is extended obliquely and inwardly.

In assembly, the lip plate 420 covers the base 11. The blocking pieces 4201, 4221 respectively rest against rear sides of the corresponding connecting pieces 32 for stopping the locking elements 30 from moving rearwards. One of the resting slices 423 clasps a connecting portion of the first shell 41 between the top plate 411 and the buckling slice 413, for fixing the first shell 41 and the second shell 42 with respect to the insulating housing 10. The parcel plate 422 bends around the base 11 and connects with the lateral plate 421 by means of the connecting tabs 425 buckling with the mating openings 4281. Consequently, the support arm 429 is disposed beneath the connecting arm 427 to form a passageway 60. A cable (not shown) passes through the passageway 60 to solder with the terminals 20, avoiding electromagnetic interference.

As described above, the first shell 41 and the second shell 42 are respectively coupled with the insertion portion 12 and the base 11, which wraps the insulating housing 10 to avoid electromagnetic interference. The second shell 42 is integral with the support arm 429 and the connecting arm 427, which surround the cable connected with the terminals 20 for avoiding electromagnetic interference. Such structure is excellent to shield the plug connector from electromagnetic interference, furthermore, simplifies manufacture and assembly.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A plug connector connected with a cable, comprising:

an insulating housing having a base and an insertion portion extended forwards from a front surface of the base, an outer peripheral dimension of the insertion portion being smaller than that of the base;

a plurality of terminals mounted into the insulating housing, each of the terminals having a soldering slice extending rearward of the base for connecting with the cable; and a shell having a first shell coupled with the insertion portion and a second shell coupled with the base, the second shell having a lip plate covering a top surface of the base, an edge of the lip plate extended downwards to form a lateral plate at a front thereof, attached to a side of the base, and a connecting arm at a rear thereof and extending apart from the lateral plate, an opposite edge of the lip plate extended downwards to form a parcel plate bent around the base to connect with the lateral plate for enclosing the base, the parcel plate having a support arm extending beneath the connecting arm to form a passageway therebetween for allowing the cable to pass therethrough to connect with the soldering slices.

2. The plug connector as claimed in claim 1, wherein the connecting arm extends at a plane of the lip plate and is integrated with a ferrule of inverted-U shape.

3. The plug connector as claimed in claim 2, wherein the ferrule is integral with a free end of the connecting arm.

4. The plug connector as claimed in claim 1, wherein the parcel plate is bent to wrap a side of the base opposite to the lateral plate, and a bottom of the base.

5. The plug connector as claimed in claim 1, wherein the lateral plate has a plurality of connecting tabs slanting outwards for buckling with mating openings formed at the parcel plate.

6. The plug connector as claimed in claim 5, wherein a free end of the parcel plate has a connecting plate at a front thereof, the support arm is at a rear of the free end of the parcel plate and spaced away from the connecting plate, the mating openings are formed at the connecting plate.

7. The plug connector as claimed in claim 1, wherein the base is rectangular, the lateral plate and the parcel plate are extended perpendicular to the lip plate.

8. The plug connector as claimed in claim 7, wherein a free end of the parcel plate has a connecting plate extending perpendicularly towards a same side as the lip plate with respect to the parcel plate at a front thereof, the support arm inclines towards a same side as the lip plate with respect to the parcel plate from a rear thereof and extending opposite to the lip plate.

9. The plug connector as claimed in claim 1, wherein front edges of the lip plate and the parcel plate respectively have a resting slice, the resting slices abut against the front surface of the base for preventing the second shell from moving rearwards.

10. The plug connector as claimed in claim 1, wherein front edges of the lateral plate and the parcel plate have portions extending to clasp the front surface of the base for preventing the second shell from moving rearwards.

11. The plug connector as claimed in claim 1, wherein the first shell has a rectangular casing surrounding an outer periphery of the insertion portion of the insulating housing.

12. The plug connector as claimed in claim 11, wherein the casing has a buckling slice at a rear thereof parallel to and higher than a top plate thereof, the buckling slice is formed with a buckling opening buckled with a protrusion of the base.

13. The plug connector as claimed in claim 12, wherein the top surface of the base has an indention area at a substantially middle portion thereof, the protrusion is located in the indention area.

14. The plug connector as claimed in claim 13, further comprising a positioning component disposed at a rear of the insulating housing for positioning the soldering slices, two opposite sides of the positioning component project outwards to form bumps, two lateral plates of the casing are extended rearwards to fix with the positioning component by means of openings formed at free ends thereof engaged with the bumps.

15. The plug connector as claimed in claim 1, wherein the terminal has a fixing slice mounted in the terminal groove, the soldering slice is extended perpendicularly from a rear of a side of the fixing slice and rearward of the fixing slice.

16. The plug connector as claimed in claim 15, further comprising a positioning component disposed at a rear of the insulating housing, the positioning component has vertical slots formed at a front thereof side by side, for receiving rear ends of the fixing slices, and flat recesses formed at a top and a bottom thereof at intervals and communicating with the corresponding vertical slots, for receiving the soldering slices.

17. The plug connector as claimed in claim 1, wherein a top of the insertion portion has two fixing grooves, each of the fixing grooves extends frontward and rearwards, and communicates with a slot which is formed at a rear of the base and extends perpendicular to an extending direction of the fixing groove, a bottom of the slot penetrates forwards to form an auxiliary recess under the fixing groove 16 and spaced away from the fixing groove.

18. The plug connector as claimed in claim 17, further comprising a locking element, the locking element has a rectangular connecting piece received in the slot, an auxiliary piece extended perpendicularly from a lower portion of a long side of the connecting piece and received in the auxiliary recess, and a locking arm extended perpendicularly from an upper portion of the long side of the connecting piece and received in the fixing groove, a free end of the locking arm resiliently projects upwards beyond the fixing groove.

19. The plug connector as claimed in claim 18, wherein the free end of the locking arm is protruded upwards to form locking end in the form of lump.

20. The plug connector as claimed in claim 18, wherein a side of the auxiliary piece adjacent to the locking arm is formed with barbs for interfering with an inner surface of the auxiliary recess.

* * * * *